United States Patent [19]

Orero et al.

[11] Patent Number: 4,679,523

[45] Date of Patent: Jul. 14, 1987

[54] FLAG HAVING A SUPPORT PEDESTAL

[76] Inventors: Francisco O. Orero; Augusto M. Garcia, both of Avda. Blasco Ibánez, 75-Paterna (Valencia), Spain

[21] Appl. No.: 761,088

[22] Filed: Jul. 31, 1985

[30] Foreign Application Priority Data

Nov. 28, 1984 [ES] Spain ..... 282991

[51] Int. Cl.[4] ..... G09F 17/00

[52] U.S. Cl. ..... 116/173

[58] Field of Search ..... 116/173; 84/95 C; 446/397

[56] References Cited

U.S. PATENT DOCUMENTS

| | | | |
|---|---|---|---|
| 423,039 | 3/1890 | Edison | 446/397 |
| 3,417,732 | 12/1968 | Platt | 116/173 |
| 3,737,749 | 6/1973 | Schmit | 116/173 |
| 4,554,856 | 11/1985 | Esaki | 84/95 C |

*Primary Examiner*—Charles Frankfort

*Assistant Examiner*—Denis E. Corr

*Attorney, Agent, or Firm*—McGlew and Tuttle

[57] ABSTRACT

A flag assembly has a pedestal frame which contains a miniature phonograph recorder that is battery operated and which has two contacts that are connectable together to activate the recorder. One contact is connected to the conductive base of a flag staff and the other contact is connected to a flexible flap which can be bent into engagement with the base to activate the recorder. A shuttle having a sleeve and a flange is slidable along the staff. In its lower position the flange presses the flexible flap against the base to activate the recorder. A flag is engaged around the sleeve. A rope has one end connected to the sleeve at an opposite end engaged around a pulley at the top of the staff and extending downwardly into the pedestal frame. A spring-loaded spool in the pedestal frame is connected to the opposite ends of the rope for winding and unwinding the rope.

1 Claim, 2 Drawing Figures

10
9
7
9
6
4
8
12
11
5
7
1
2
3

10
10
8

10

FLAG HAVING A SUPPORT PEDESTAL

SUMMARY OF THE INVENTION

The invention refers to a flag having a support pedestal.

In general terms, the flag is fixed at one of its side ends to a shuttle slidable on the staff which is attached to a pedestal comprised of a frame in which is incorporated a miniature phonographic recorder and the corresponding electric battery for feeding a micromotor which operates the said recorder. Likewise, the frame constituting the pedestal has a winding spool with a recovery spring for a rope sliding parallel to the staff and passing along a pulley located at the upper zone thereof, the rope ending in the flag bearing shuttle. One of the terminals of the electric circuit of the phonographic recorder is connected to the staff base and the other terminal to a flexible metal flap placed close to the staff, the bottom end of the shuttle being capable of exerting pressure on the said flap to thereby close the circuit which operates the miniature phono- graphic recorder.

When the flag is manually lowered by sliding the shuttle towards the zone of the base, the recovery spring of the winding spool is loaded and the recorder is simultaneously operated, since its corresponding circuit is closed by the folding of the flexible metal flap over the other terminal of the circuit comprised of the staff base. Thus, when the flag bearing shuttle is released, the flag is hoisted due to the recovery produced by the spring on the winding spool.

DETAILED DESCRIPTION OF THE INVENTION

Figure 1:
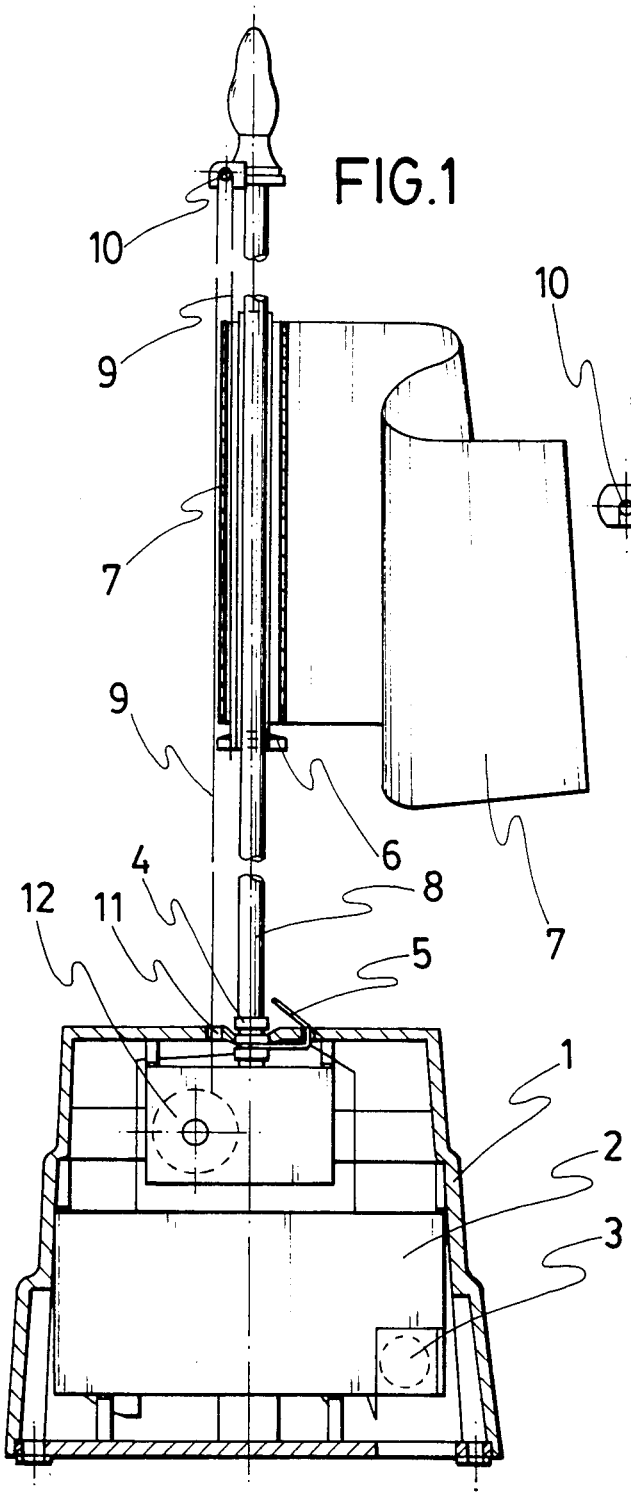
FIG. 1 illustrates a sectional view of the flag disposed on the shuttle sliding on the staff which, in turn, is attached to the pedestal.
Figure 2:
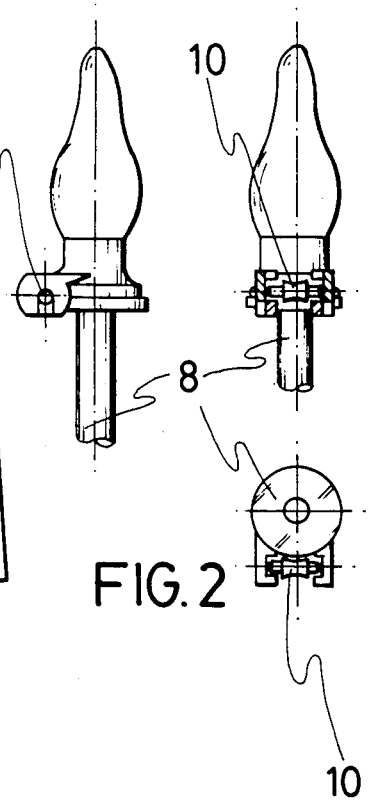
FIG. 2 shows different views of the upper zone of the staff at which the pulley, along which the rope joining the winding spool to the flag bearing shuttle slides, is situated.

The pedestal 1 comprises a frame in which is housed a miniature phonographic recorder 2 and the corresponding electric battery 3 for feeding the micromotor which operates the said recorder, whose electric circuit is closed by a contactor formed of the base 4 of the staff to which one current terminal is connected, a flexible metal flap 5 placed close to the staff being connected to the other terminal.

The flap 5 is activated by the displacement of the lower base of a shuttle 6 about which is disposed one end of the flag 7. The shuttle 6 has a sleeve which is telescoped in and slides freely along the staff 8. The shuttle 6 is joined to the end of a rope 9 which is pulled up to the end of the staff 8, surrounding a small pulley 10 disposed for such purpose in a radial position, the said rope 9 being lowered until it passes through the upper surface of the pedestal 1 through a hole 11. The other end of the rope 9 is joined to a winding spool 12 provided with a recovery spring. The shuttle 6 also has a lower flange that can press down onto the free end of flap 5 to push it against base 4.

With this constitution, the flag having a support pedestal operates as follows:

When the flag 7 is in its hoisted position, it is lowered by manually activating the shuttle 6, causing in such displacement the recovery spring of the winding spool 12 to be loaded and furthermore the flap 5 to contact the base 4 of the staff 8, whereby the circuit is closed and consequently the miniature phonographic recorder 2 will operate. After this, due to the load of the recovery spring, the shuttle 6 is raised by the action of the rope 9 which is wound on the winding spool 12 to its hoisted position.

We claim:

1. A flag assembly comprising a pedestal frame (1) defining a space therein and having an upper rope receiving opening (11), a staff (8) connected to said frame and extending upwardly therefrom, said staff having a conductive base (4) adjacent said frame, a flexible conductive flap (5) connected to said frame and having a free end extending upwardly from said frame near said base, a miniature battery operated phonograph recorder (2) in said pedestal frame and having a pair of contacts which are closable with each other to activate said recorder, one of said contacts being electrically connected to said flap and the other of said contacts being electrically connected to said base so that said recorder is activated when said flap is engaged with said base, a pulley (10) rotatably mounted near a top end of said staff, a shuttle (6) having a sleeve telescopically slidable over said staff for upward and downward movement along said staff, said shuttle having a lower flange which is engageable against said flap to move said flap against said base when said shuttle is near a bottom of said staff to activate said recorder, a rope having one end connected to said shuttle and being entrained over said pulley, said rope having an opposite end extending through said opening (11) in said frame and into said frame, a spring-loaded winding spool (12) rotatably mounted in said frame and connected to said opposite end of said rope, said opposite end of said rope being windable on said spool for raising said shuttle and unwindable from said spool for lowering said shuttle and loading said spring-loaded winding spool, said spool being rotatable by a spring when said shuttle is in its lowered position to rotate said spool to raise said shuttle, and a flag (7) having a portion engaged around said sleeve of said shuttle for being raised and lowered with said shuttle.

* * * * *